United States Patent [19]

Tang et al.

[11] Patent Number: 4,675,630

[45] Date of Patent: Jun. 23, 1987

[54] TRIPLE MODE DIELECTRIC LOADED BANDPASS FILTER

[75] Inventors: Wai-Cheung Tang, Kitchener; David Siu, Hamilton; Bruce C. Beggs, Mississauga; Joseph Sferrazza, Hamilton, all of Canada

[73] Assignee: Com Dev Ltd., Cambridge, Canada

[21] Appl. No.: 804,078

[22] Filed: Dec. 3, 1985

[30] Foreign Application Priority Data

Jan. 14, 1985 [CA] Canada ..... 472072

[51] Int. Cl.[4] ..... H01P 1/208; H01P 7/06; H01P 7/10

[52] U.S. Cl. ..... 333/208; 333/212; 333/231; 333/235

[58] Field of Search ..... 333/202, 208–212, 333/227–235, 206–207

[56] References Cited

U.S. PATENT DOCUMENTS

| | | | |
|---|---|---|---|
| 2,890,421 | 6/1959 | Currie | 333/208 |
| 4,410,865 | 10/1983 | Young et al. | 333/209 X |
| 4,489,293 | 12/1984 | Fiedziuszko | 333/209 X |

*Primary Examiner*—Marvin L. Nussbaum

*Attorney, Agent, or Firm*—Daryl W. Schnurr

[57] ABSTRACT

A triple mode dielectric loaded bandpass filter has at least one cavity resonating in three independent orthogonal modes. A triple mode cavity can be mounted adjacent to either single, dual or triple mode cavities. Intercavity coupling is achieved through the iris having two separate apertures that together form a T-shape. The cavities can be planar mounted. The filter is designed for use in the satellite communication industry and results in substantial savings in weight and size when compared to previous filters.

16 Claims, 12 Drawing Figures

TRIPLE MODE DIELECTRIC LOADED BANDPASS FILTER

BACKGROUND OF THE INVENTION

1. Field of the Invention

This invention relates to a triple mode dielectric loaded bandpass filter. In particular, this invention relates to a bandpass filter having one or more cascaded dielectric loaded waveguide cavities resonating in three independent orthogonal modes, simultaneously. Dielectric loaded triple mode cavities can be used in combination with dual or single mode cavities.

2. Description of the Prior Art

In the Fall of 1971, in COMSAT Technical Review, Volume 1, pages 21 to 42, Atia and Williams suggested the possibility of cascading two triple-mode waveguide cavities to realize a six-pole elliptic filter. However, Atia and Williams were unable to achieve the suggested results.

SUMMARY OF THE INVENTION

It is an object of the present invention to provide a triple mode bandpass filter wherein each cavity contains a dielectric resonator. It is a further object of the present invention to provide a triple mode bandpass filter where cavities resonating in a triple mode are mixed with cavities resonating in a dual or single mode.

In accordance with the present invention, a triple mode function bandpass filter has at least one cavity resonating in three independent orthogonal modes, one of said modes being different from the other two modes, said filter having an input and output for transferring electromagnetic energy into and out of said filter, each cavity having a longitudinal axis that is parallel to a side wall of said cavity, each triple mode cavity having three coupling screws and three tuning screws mounted therein, said coupling screws coupling energy from one mode to another and each of said tuning screws controlling the resonant frequency of a different mode, each triple mode cavity having a dielectric resonator mounted coaxially with the longitudinal axis of that cavity.

Preferably, the filter is a planar filter and the dielectric resonator is planar mounted.

DESCRIPTION OF A PREFERRED EMBODIMENT

Figure 1:
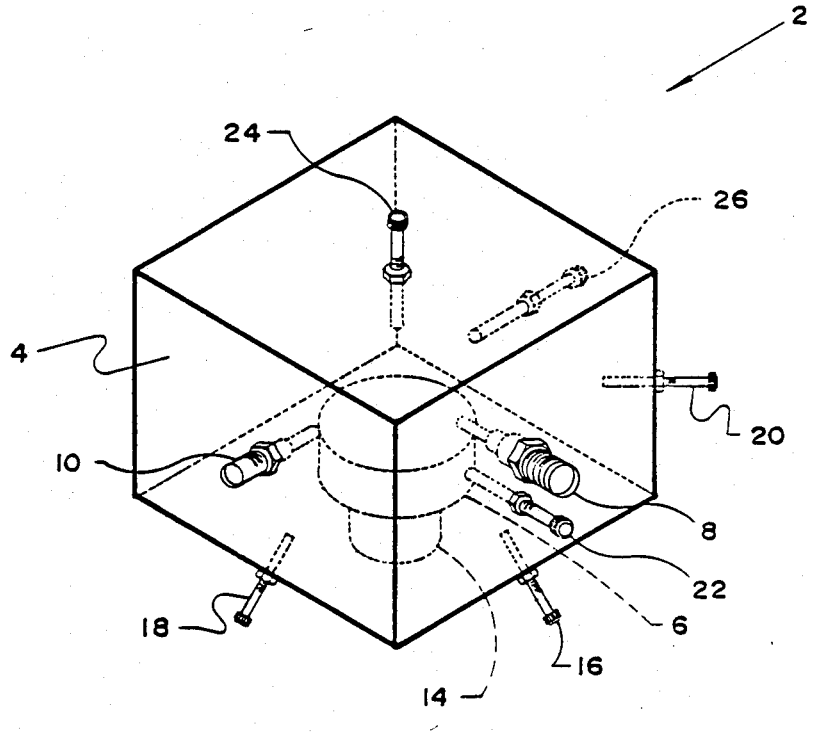
FIG. 1 is a perspective view of a triple mode bandpass filter having one cavity.
Figure 2:
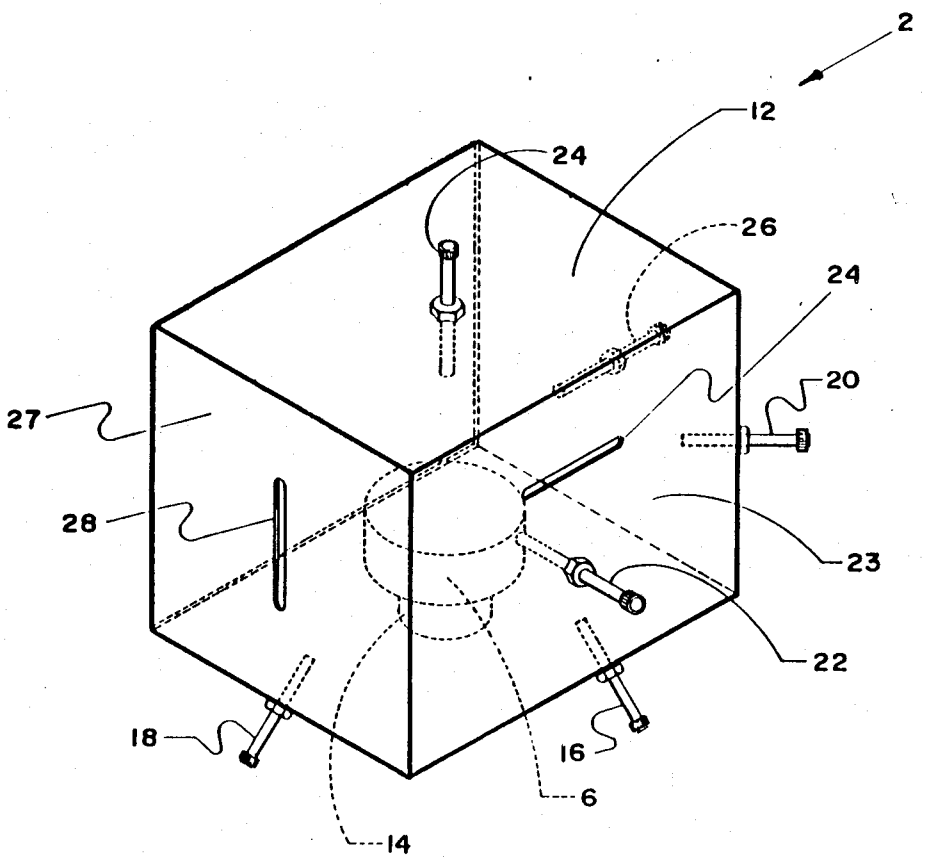
FIG. 2 is a perspective view of a triple mode function bandpass filter using an aperture on an iris for input and output coupling.

Referring to the drawings in greater detail, in FIG. 1, a triple-mode function bandpass filter 2 has one waveguide cavity 4 resonating in three independent orthogonal modes. The cavity 4 has a dielectric resonator 6 mounted therein. Preferably, the filter 2 is a planar filter and the dielectric resonator 6 is planar mounted as shown in FIG. 2. A "planar filter" is defined as being a filter having cavities that are planar mounted. "Planar mounted" when used in relation to cavities, is defined as being cavities that are mounted side-by-side with each cavity having a longitudinal axis that is parallel to a longitudinal axis of the remaining cavities that are planar mounted. The longitudinal axis of each cavity is parallel to a side wall of that cavity and each cavity has a different longitudinal axis. The dielectric resonator of each cavity is also planar mounted in that it is mounted coaxially with the longitudinal axis of that cavity. Further, each of said adjacent cavities has a square cross-sectional shape transverse to said longitudinal axis. The filter 2 can be made to resonate in a first $HE_{111}$ mode, a second $TM_{011}$ mode and a third $HE_{111}$ mode. The filter 2 is not restricted to these modes and can operate in any two $HE_{11(N+1)}$ modes and a $TM_{01N}$ mode, where N is a positive integer. Input and output energy transfer is provided by coaxial probes 8, 10 respectively. The probes 8, 10 couple electric field energy parallel to the direction of the probe into and out of the first $HE_{111}$ and the third $HE_{111}$ modes respectively. Input and output coupling can be provided in other ways as well. For example, as shown in FIG. 2, energy can be coupled into and out of a particular cavity by means of magnetic field transfer through apertures 28, 24 located on irises 27, 23 respectively.

The dielectric resonator 6 used in the filter 2 has a high dielectric constant, a low-loss tangent and a low temperature drift coefficient value. The frequency at which the dielectric resonator resonates for a particular mode is directly related to the diameter/length ratio of the dielectric resonator 6. A diameter/length ratio was calculated for the dielectric resonator 6 so that the $HE_{111}$ mode and the $TM_{011}$ mode resonate at the same frequency. The resonator 6 used in the filter 2 is planar mounted on a low-loss, low dielectric constant support 14.

Figure 3A:
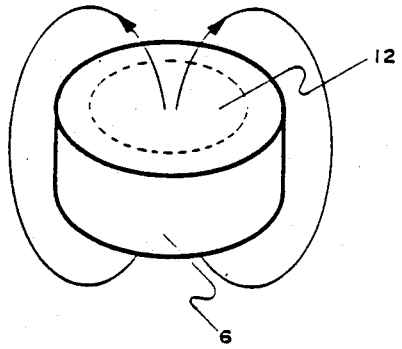
FIGS. 3A, 3B and 3C are schematic views showing field patterns for $TM_{011}$ and $HE_{111}$ modes that can be used with the filter of the present invention.
Figure 3B:
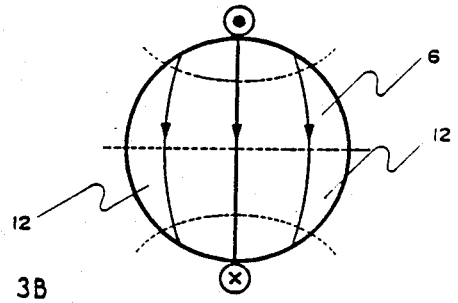
Figure 3C:
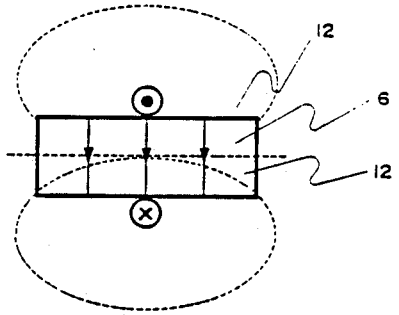

In FIGS. 3A, 3B and 3C, the electrical and magnetic field patterns about the resonator 6 are shown. The electrical field patterns are depicted with a solid line with an arrowhead thereon and the magnetic field patterns are depicted with a dotted line. FIG. 3A is a perspective view of the resonator 6, FIG. 3B is a top view and FIG. 3C is a front view of said resonator. The electrical field patterns of the second $TM_{011}$ mode are shown in FIG. 3A while the electrical field patterns of the $HE_{111}$ mode are shown in FIGS. 3B and 3C. From FIG. 3A, it can be seen that the $TM_{011}$ mode has a maximum electrical field strength normal to a surface 12 of the resonator 6. From FIGS. 3B and 3C, it can be seen that the $HE_{111}$ mode has a maximum electrical field strength parallel to the surface 12 of the resonator 6.

By the proper use of coupling screws, a third $HE_{111}$ mode having an electrical field parallel to the dielectric surface 12 and perpendicular to both the first $HE_{111}$ mode and the second $TM_{011}$ mode can be made to resonate in the cavity 4.

There are three coupling screws 16, 18, 20 that are located at a 45° angle from the maximum electrical field in the filter 2. A metallic coupling screw is a physical discontinuity which perturbs the electrical field of one mode to couple energy into another mode. As previously stated, the input probe 8 couples electrical field energy to the first $HE_{111}$ mode parallel to the direction of said probe 8. Coupling screw 16 couples energy between the first $HE_{111}$ mode and the second $TM_{011}$ mode. Coupling screw 18 couples energy between the second $TM_{011}$ mode and the third $HE_{111}$ mode. Coupling screw 20 couples energy between the first $HE_{111}$ mode and the third $HE_{111}$ mode. Output probe 10 couples electrical field energy from the third $HE_{111}$ mode in a direction parallel to said probe 10.

A tuning screw is located in the direction parallel to the maximum electrical field strength of a particular mode and is used to control the resonant frequency of said mode. When a tuning screw approaches the dielectric resonator surface 12, it effectively increases the electrical length of the dielectric resonator, thereby resulting in a decrease of the resonant frequency. For filter 2, the tuning screws 22, 24, 26 control the resonant frequencies of the first $HE_{111}$ mode, the second $TM_{011}$ mode and the third $HE_{111}$ mode respectively.

Figure 4:
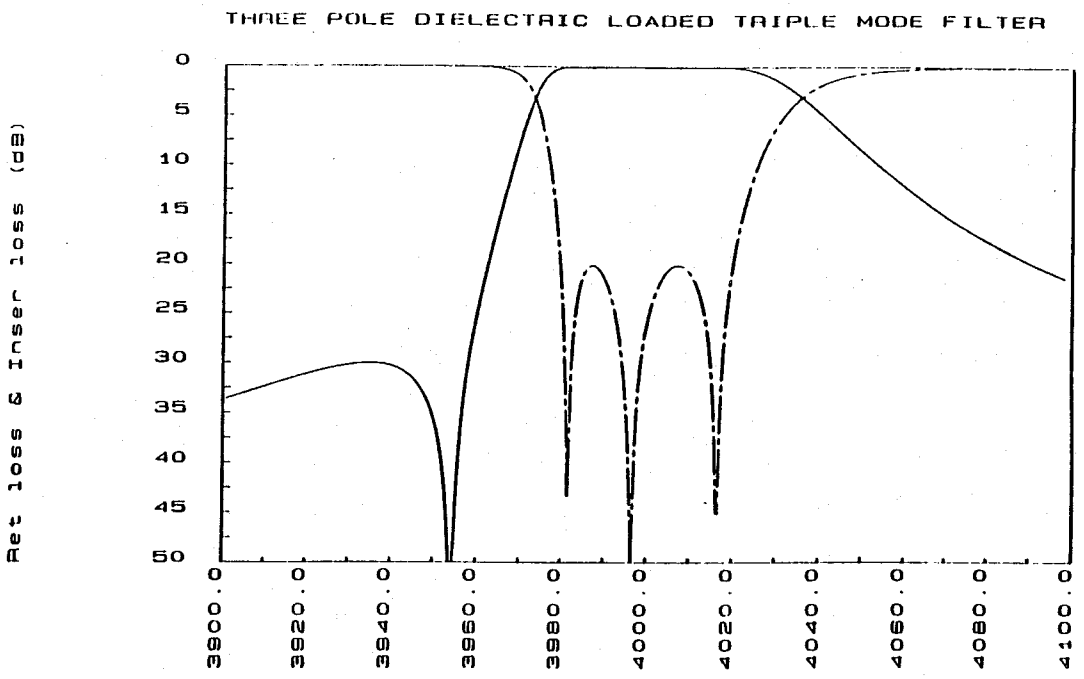
FIG. 4 is a graph of a simulated response of an asymmetric three-pole filter with one transmission zero.

The filter 2 produces an asymmetric response where only one transmission zero exists. In general, transmission zeros are created when feed back couplings are implemented. In filter 2, the coupling screw 20, which couples energy between the first $HE_{111}$ mode and the third $HE_{111}$ mode provides a feed back coupling which results in a three-pole asymmetric response with one transmission zero. A simulated response of this asymmetric response is illustrated in FIG. 4.

Figure 5:
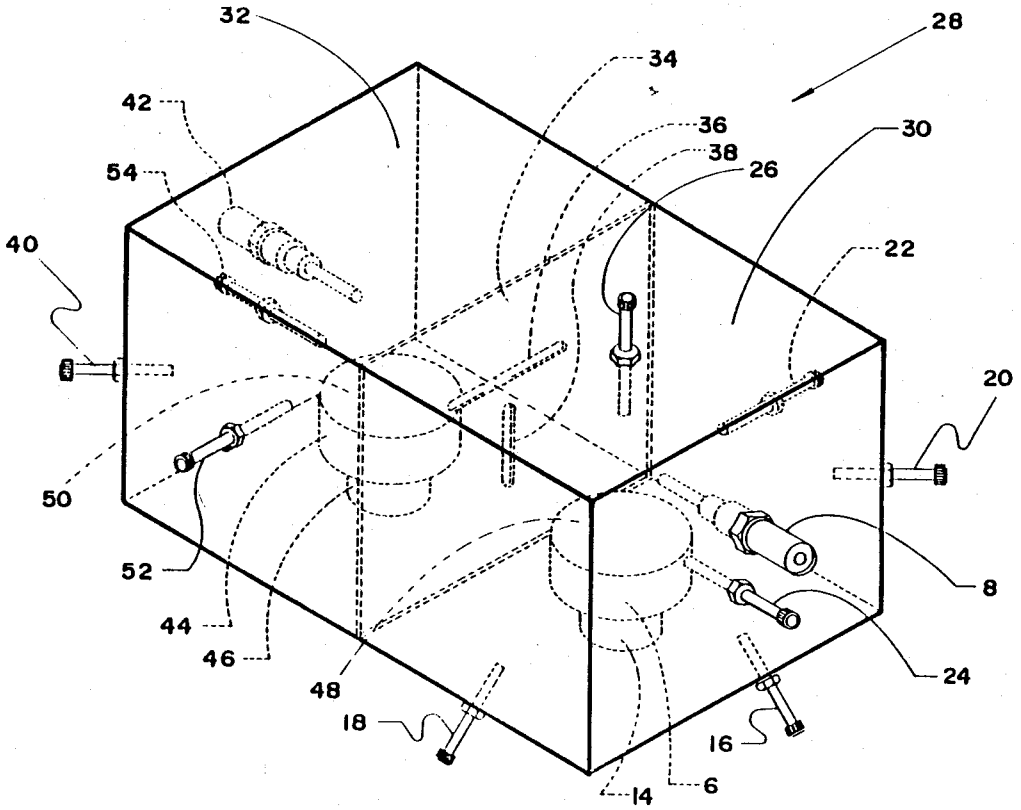
FIG. 5 is a perspective view of a five-pole dielectric-loaded bandpass filter having two cavities.

In FIG. 5, there is shown a further embodiment of the invention in which a five-pole elliptic bandpass filter 28 has two cavities 30, 32. The cavity 30 resonates in a triple mode and the cavity 32 resonates in a dual mode. Since the cavity 30 is essentially the same as the cavity 4 of the filter 2, the same reference numerals are used for those components of the cavity 30 that are essentially the same as the components of the cavity 4. The cavity 30 contains a dielectric resonator 6 that is mounted on a low-loss, low dielectric constant support 14. The resonator 6 is planar mounted within the planar cavity 30. The cavity 30 resonates in a first $HE_{111}$ mode, a second $TM_{011}$ mode and a third $HE_{111}$ mode in a manner similar to the cavity 4 of the filter 2. The cavity 32 resonates in two $HE_{111}$ modes. The cavity 30 is the input cavity to the filter 28 and an input probe 8 couples electrical field energy to the first $HE_{111}$ mode parallel to the direction of said input probe. Energy from the first $HE_{111}$ mode is coupled to the second $TM_{011}$ mode due to the perturbation of fields created by the coupling screw 16. Energy in turn is coupled from the second $TM_{011}$ to the third $HE_{111}$ mode by means of the coupling screw 18. Coupling screw 20 provides a feed back coupling between the first and third $HE_{111}$ modes. The magnitude of the feed back coupling depends upon the penetration of the coupling screw 20 within the cavity 30.

Figure 6:
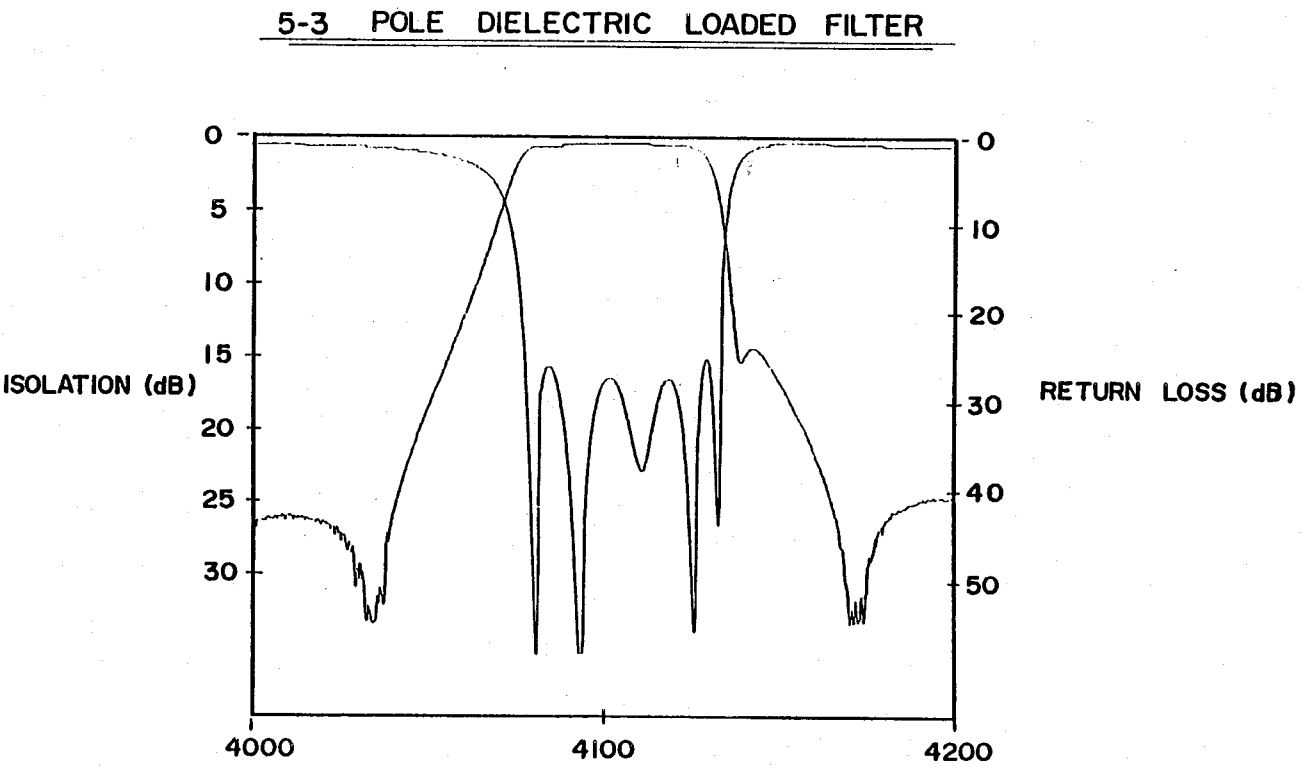
FIG. 6 is a graph showing the measured transmission and return loss response of the five-pole filter shown in FIG. 4.

Located between the cavity 30 and the cavity 32 is an iris 34 having apertures 36, 38 positioned to couple energy between the adjacent cavities 30, 32. The apertures 36, 38 are normal to one another, each aperture being symmetrical about an imaginary centre line of said iris 34, said centre line being parallel to an axis of the resonator 6. Aperture 38 on iris 34 provides a means by which energy is coupled from the third $HE_{111}$ mode in cavity 30 to a fourth $HE_{111}$ mode in cavity 32 through magnetic field transfer across said aperture. Energy from the fourth $HE_{111}$ mode to a fifth $HE_{111}$ mode is through coupling screw 40. Both the fourth $HE_{111}$ mode and the fifth $HE_{111}$ mode resonate in the cavity 32. Energy output from the cavity 32 is through an output probe 42 in a direction parallel to said probe. The output probe 42 of cavity 32 is similar to the output probe 10 of cavity 4 of FIG. 1. A second feed back coupling is provided through the aperture 36 of the iris 34. This feed back coupling occurs between the first $HE_{111}$ mode and the fifth $HE_{111}$ mode by means of electrical field energy coupling across aperture 36. The cavity 32 has a dielectric resonator 44 mounted therein on a low-loss, low dielectric constant support 46. The length and height of the aperture 36 relative to top surfaces 48, 50 of the dielectric resonators 6, 44 respectively determines the magnitude of the second feed back coupling. The two feed back couplings together create the three transmission zeros of the measured isolation response of the filter 28 as shown in FIG. 6. The return loss of the filter 28 is also shown in FIG. 6.

The resonant frequency of the first and third $HE_{111}$ modes in cavity 30 is controlled by tuning screws 24, 22 respectively. Tuning screw 63 controls the resonant frequency of the second $TM_{011}$ mode in cavity 30. The resonant frequency of the fourth and fifth $HE_{111}$ modes in cavity 32 is controlled by tuning screws 52, 54 respectively. By increasing the penetration of the tuning screws 22, 24, 26, 53, 54 the resonant frequency of each of the five modes can be decreased.

Figure 7:
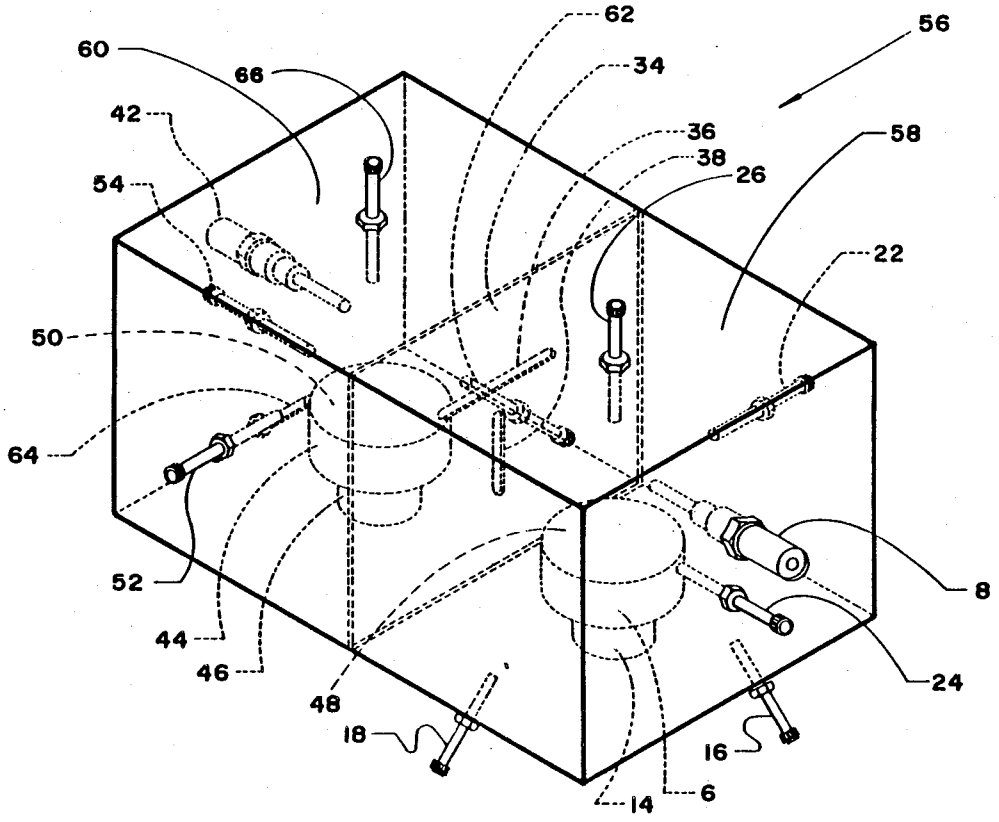
FIG. 7 is a perspective view of a six-pole dielectric-loaded bandpass filter having two cavities.

In FIG. 7, there is shown a further embodiment of the invention in which a six-pole elliptic bandpass filter 56 has two adjacent cavities 58, 60, each of said cavities resonating in a triple mode. The same reference numerals will be used in FIG. 7 to describe those components of the cavities 58, 60 that are similar to the components used in cavities 30, 32 of FIG. 4. The cavities 58, 60 of the filter 56 function in a very similar manner to the cavity 30 of the filter 28. The cavity 58 is the input cavity and resonates in a first $HE_{111}$ mode, a second $TM_{011}$ mode and a third $HE_{111}$ mode. The input coupling 24 couples energy into the cavity 58. The cavity 60 is the output cavity and resonates in a fourth $HE_{111}$ mode, a fifth $TM_{011}$ mode and a sixth $HE_{111}$ mode. Energy is coupled out of the filter 56 through output probe 42 that is mounted in a cavity 60.

Transfer of energy from the first $HE_{111}$ mode to the second $TM_{011}$ mode in the cavity 58 is through coupling screw 16. Transfer of energy from the second $TM_{011}$ mode to the third $HE_{111}$ mode is through coupling screw 18. Transfer of energy from the third $HE_{111}$ mode in the cavity 58 to the fourth $HE_{111}$ mode in the cavity 60 is through aperture 38 on iris 34. Transfer of energy from the fourth $HE_{111}$ mode to the fifth $TM_{011}$ mode is through the coupling screw 62. Transfer of energy from the fifth $TM_{011}$ mode to the sixth $HE_{111}$ mode in the cavity 60 is through coupling screw 64. Resonant frequencies of modes one to three in cavity 58 are controlled by tuning screws 24, 26, 22 respectively.

Resonant frequencies of modes four to six in cavity 60 are controlled by tuning screws 52, 54, 66 respectively.

The filter 56 produces a six-pole elliptic bandpass response with four transmission zeros. The transmission zeros are created by feed back couplings between the first and sixth $HE_{111}$ mode (i.e. the $M_{16}$ coupling value) and between the second and fifth $TM_{011}$ modes (i.e. the $M_{25}$ coupling value). These two intercavity feed back couplings are achieved through aperture 36 on iris 34.

Figure 8:
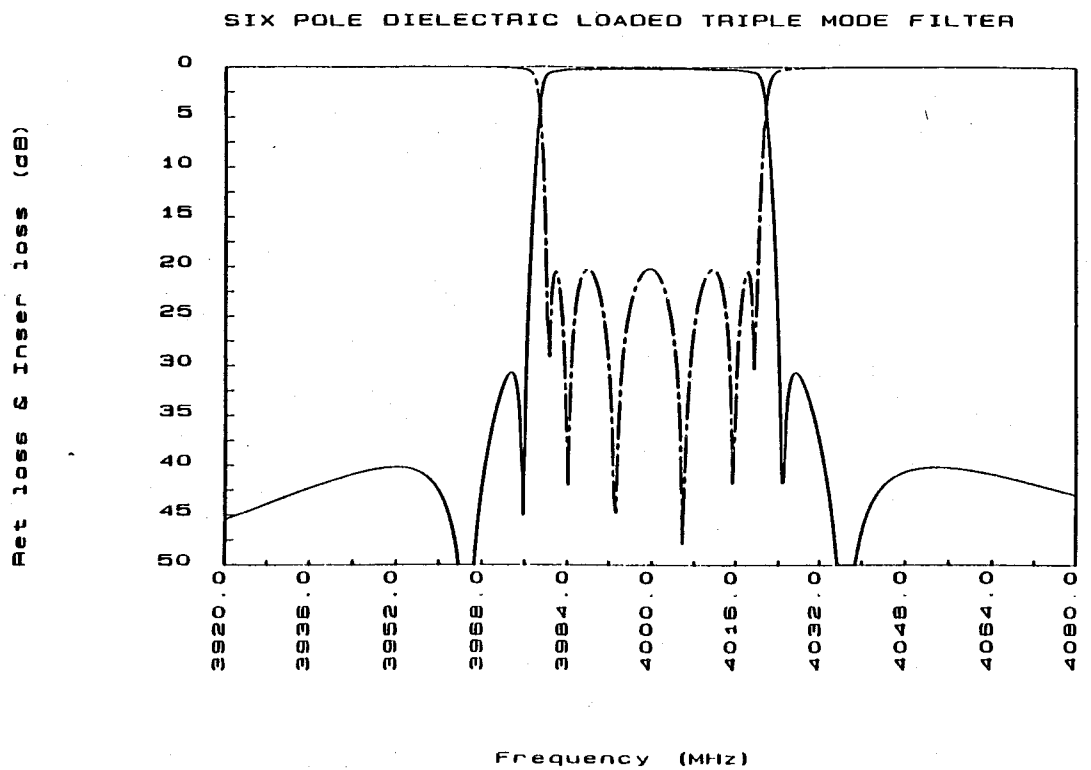
FIG. 8 is a graph showing the simulated response of the asymmetric six-pole bandpass filter of FIG. 6 with four transmission zeros.

In FIG. 8, there is shown the simulated response of a six-pole elliptic bandpass filter constructed in accordance with FIG. 7 with four transmission zeros. Since the maximum field points of the first and sixth modes occur at a different location from that of a second and fifth modes, by varying the vertical position and the length of the aperture 36, the two feed back couplings can be controlled independently.

Figure 9:
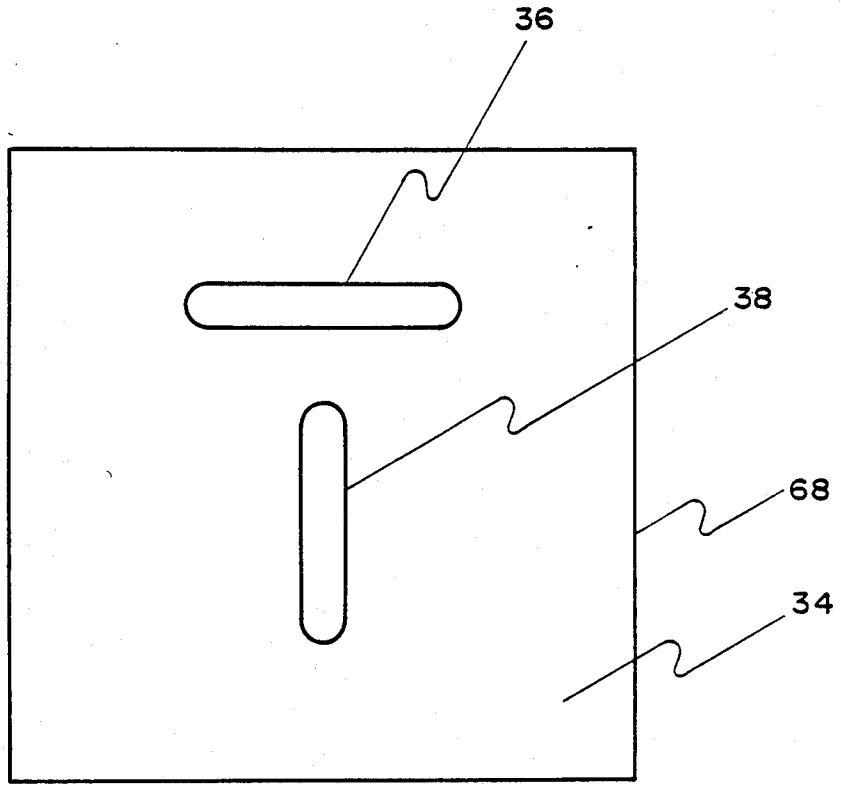
FIG. 9 is a side view of an iris used for inter-cavity coupling in the five-pole and six-pole filters shown in FIGS. 4 and 6.

In FIG. 9, there is shown a side view of the iris 34 with apertures 36, 38. While the filter will still function if the apertures 36, 38 are moved vertically to a different position relative to one another from that shown in FIG. 9, the position shown in FIG. 9 is a preferred position. If desired, the apertures 34, 36 could be positioned to intersect one another. However, the apertures 36, 38 must always be located so that they are symmetrical about an imaginary centre line of said iris 34, said centre line being parallel to an axis of said dielectric resonator. In the iris 34 shown in FIG. 9, the imaginary centre line extends vertically across the iris 34 midway between side edges 68.

Figure 10:
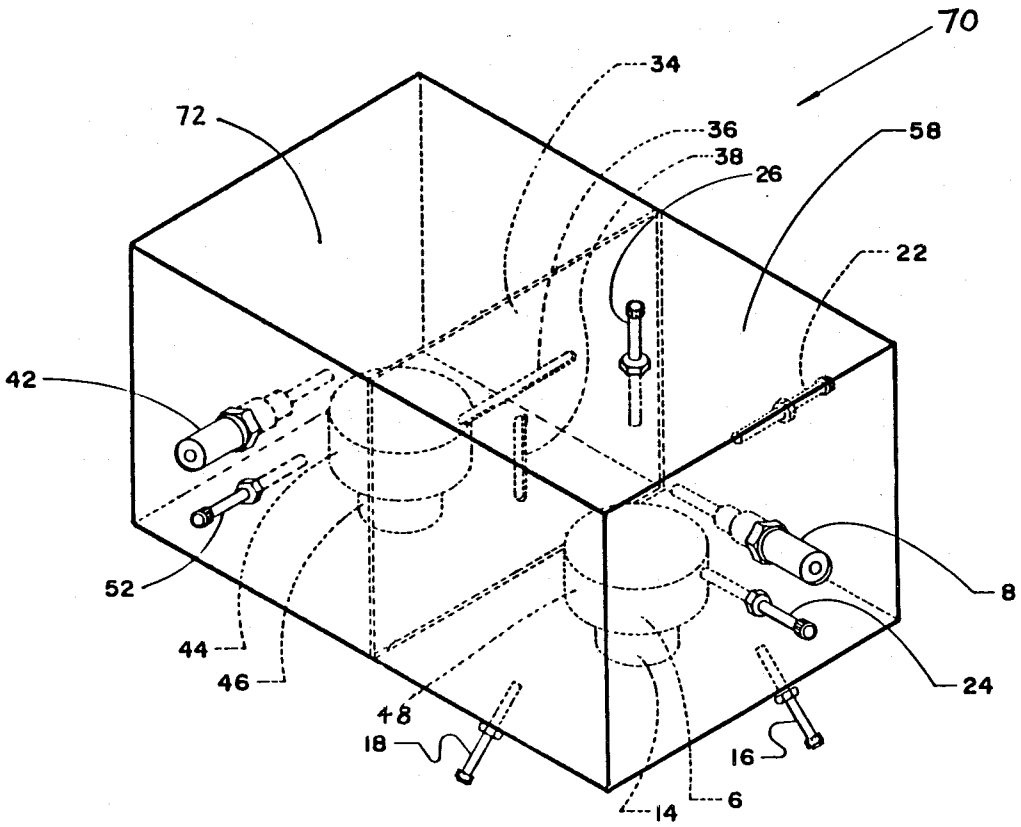
FIG. 10 is a perspective view of a four-pole dielectric-loaded bandpass filter having two cavities.

Referring to FIG. 10 in greater detail, there is shown a further embodiment of the invention in which a four pole elliptic bandpass filter 70 has two adjacent cavities 58, 72. Cavity 58 resonates in a triple mode and cavity 72 resonates in a single mode. The same reference numerals will be used in FIG. 10 to describe those components of the cavities 58, 72 that are similar to the components used in cavities 58, 60 of FIG. 7. The cavity 58 of the filter 70 functions in an identical manner to the cavity 58 of the filter 56 as shown in FIG. 7. The cavity 58 is the input cavity and resonates in a first $HE_{111}$ mode, a second $TM_{011}$ mode and a third $HE_{111}$ mode. The input coupling 24 couples energy into the cavity 58. The cavity 72 is the output cavity and resonates in a fourth $HE_{111}$ mode. Energy is coupled out of the filter 70 through the output probe 42 that is mounted in the cavity 72.

Transfer of energy from the first $HE_{111}$ mode to the second $TM_{011}$ mode in the cavity 58 is through coupling screw 16. Transfer of energy from the second $TM_{011}$ mode to the third $HE_{111}$ mode is through coupling screw 18. Transfer of energy from the third $HE_{111}$ mode in the cavity 58 to the fourth $HE_{111}$ mode in the cavity 60 is through aperture 38 on iris 34. A feed back coupling is provided through the aperture 36 of the iris 34 between the first $HE_{111}$ mode and the fourth $HE_{111}$ mode by means of electrical field energy coupling across said aperture. Resonant frequencies of modes one to three in cavity 58 are controlled by tuning screws 24, 26, 22 respectively. The resonant frequency of the fourth mode in cavity 72 is controlled by tuning screw 52.

While the filters shown in FIGS. 5, 7 and 10 are described as resonating in $HE_{111}$ and $TM_{011}$ modes, it should be understood that a filter in accordance with the present invention can be made to operate in any $HE_{11(N+1)}$ mode and $TM_{01N}$ mode, where N is a positive integer. Also, the filters shown in FIGS. 5, 7 and 10 have only two cavities. A filter in accordance with the present invention could be constructed with any resonable number of cavities and triple mode cavities can be cascaded with other triple, dual or single mode cavities to form even or odd order filter functions. In FIGS. 1, 5, 7 and 10 input and output couplings are achieved with coaxial probes. In a variation of these filters, input and output coupling can be achieved with a ridge waveguide structure operating in a $TE_{01}$ mode in an under cut-off condition.

A filter constructed in accordance with the present invention can achieve weight and size reductions of approximately one-half. This is very important when the filter is used for satellite communications. For example, it is possible to design a filter with a $K^{th}$ order, K being a multiple integer of 3, the filter having only K/3 cavities. Also, improved thermo stability can be achieved with the filters of the present invention relative to known triple mode or dual mode filters. In dielectric-loaded waveguide filters, the cavity dimensions are not critical thus, the thermal properties of the filter will be determined mainly by the thermal properties of the dielectric resonators.

What we claim as our invention is:

1. A triple mode function bandpass filter comprising at least one waveguide cavity resonating in three independent orthogonal modes, one of said modes being different from the other two modes, said filter having an input and output for transferring electromagnetic energy into and out of said filter, each cavity having a longitudinal axis that is parallel to a side wall of said cavity, each triple mode cavity having three coupling screws and three tuning screws mounted therein, said coupling screws coupling energy from one mode to another and each of said tuning screws controlling the resonant frequency of a different mode, each triple mode cavity having a dielectric resonator mounted coaxially with the longitudinal axis of that cavity.

2. A bandpass filter as claimed in claim 1 wherein the filter is a planar filter and the dielectric resonator is planar mounted.

3. A bandpass filter as claimed in claim 2 wherein the filter operates in two $HE_{11(N+1)}$ modes and a $TM_{01N}$ mode, where N is a positive integer.

4. A bandpass filter as claimed in any one of claims 1, 2 or 3 wherein the dielectric resonator is mounted on a low-loss, low dielectric constant support.

5. A bandpass filter as claimed in claim 2 wherein there are at least two cavities and an inter-cavity coupling iris being located between adjacent cavities, said iris having appropriate apertures positioned to couple energy between adjacent cavities, each of said . cavities having a dielectric resonator mounted therein.

6. A bandpass filter as claimed in claim 5 wherein there are at least two triple mode cavities adjacent to one another.

7. A bandpass filter as claimed in claim 5 wherein there is at least one single mode cavity adjacent to said triple mode cavity.

8. A bandpass filter as claimed in claim 5 wherein there is at least one dual mode cavity adjacent to said triple mode cavity.

9. A bandpass filter as claimed in any one of claims 6, 7 or 8 wherein the iris has two apertures, said apertures being normal to one another, each aperture being symmetrical about one centre of line of said iris, said centre line being parallel to an axis of said dielectric resonator.

10. A bandpass filter as claimed in any one of claims 6, 7 or 8 wherein the iris has two apertures spaced apart from one another, each aperture being symmetrical about one centre line of said iris, said centre line being parallel to an axis of said dielectric resonator.

11. A bandpass filter as claimed in any one of claims 1, 2 or 5 wherein input and output coupling is achieved via coaxial probes.

12. A bandpass filter as claimed in any one of claims 1, 2 or 5 wherein input and output coupling is achieved with a ridge waveguide structure operating in a $TE_{01}$ mode in an under cut-off condition.

13. A bandpass filter as claimed in claim 1 wherein there are at least two cavities and an inter-cavity coupling iris located between adjacent cavities, said iris having appropriate apertures positioned to couple energy between adjacent cavities, each of said cavities having a dielectric resonator mounted therein.

14. A bandpass filter as claimed in claim 13 wherein there are at least two triple mode cavities adjacent to one another.

15. A bandpass filter as claimed in claim 13 wherein there is at least one single mode cavity adjacent to said triple mode cavity.

16. A bandpass filter as claimed in claim 13 wherein there is at least one dual mode cavity adjacent to said triple mode cavity.

* * * * *